United States Patent [19]

Price

[11] Patent Number: 4,912,864

[45] Date of Patent: Apr. 3, 1990

[54] MAGNETIZED PICTURE FRAME

[76] Inventor: Ruth A. Price, 598 Lake Meade Dr., East Berlin, Pa. 17316

[21] Appl. No.: 283,452

[22] Filed: Dec. 12, 1988

[51] Int. Cl.[4] ..... A47G 1/06; G09F 1/12

[52] U.S. Cl. ..... 40/155; 40/152; 40/649; 40/600

[58] Field of Search ..... 40/152, 152.1, 155, 40/159.1, 600, 621, 649, 642

[56] References Cited

U.S. PATENT DOCUMENTS

| | | | |
|---|---|---|---|
| 3,826,026 | 7/1974 | Bevan | 40/600 |
| 4,041,630 | 8/1977 | Holbrook | 40/649 |
| 4,149,331 | 4/1979 | Prager | 40/649 |
| 4,310,978 | 1/1982 | Stern | 40/600 |
| 4,377,915 | 3/1983 | Zossimas et al. | 40/155 |
| 4,525,945 | 7/1985 | Shultz | 40/152 |
| 4,662,092 | 5/1987 | Kim | 40/155 |
| 4,785,562 | 11/1988 | Good | 40/159.1 |

*Primary Examiner*—Gene Mancene
*Assistant Examiner*—Michael Lynch

[57] ABSTRACT

A frame for displaying informational sheet material on a steel refrigerator. Permanent magnets are formed in the frame to magnetically adhere the frame to the refrigerator surface. The frame is preferably formed of thin-walled plastic tubing to reduce total frame weight.

4 Claims, 1 Drawing Sheet

MAGNETIZED PICTURE FRAME

BACKGROUND AND SUMMARY OF THE INVENTION

This invention relates to picture frames, especially picture frames usable on steel surfaces. The invention presents an alternative construction to known magnetic devices used to attach notes, newspaper articles, etc. onto the front surfaces of refrigerator doors.

One known magnetic attachment device comprises a circular disc having a diameter of about two inches. The front (exposed) face of the disc has a picture thereon, e.g. a flower; the rear face of the disc is a thin permanent magnet. Disc thickness is about one eighth inch. In use, the disc is placed over a piece of paper held against the surface of the family refrigerator; magnetic attractive force holds the disc and paper sheet on the steel refrigerator surface.

A disadvantage of the known arrangement is the fact that the disc partially hides the paper and some of the information thereon. Another disadvantage is that the magnetic force due to a single magnetic disc may be insufficient to support a large sheet of paper, especially if the paper is slippery or heavy (thick). Also, the magnetic disc is not especially useful for photographs or greeting cards that are heavier than paper. Additionally, any irregular edges on the sheet (due to tearing or choppy scissors cuts) are visible and give a cluttered disordered appearance.

My invention relates to a light weight picture frame that can be magnetically attached to a refrigerator surface, or other steel surface, to display sheet material, e.g. a note, message, photograph, greeting card, etc. The frame is adapted to hold relatively thick or heavy sheets without danger that the sheet will fall to the floor; the sheet can have a slippery (glossy) surface without adversely affecting the ability of the frame to retain the sheet on the refrigerator surface.

THE DRAWINGS

DESCRIPTION OF A PREFERRED EMBODIMENT OF THE INVENTION

Figure 1:
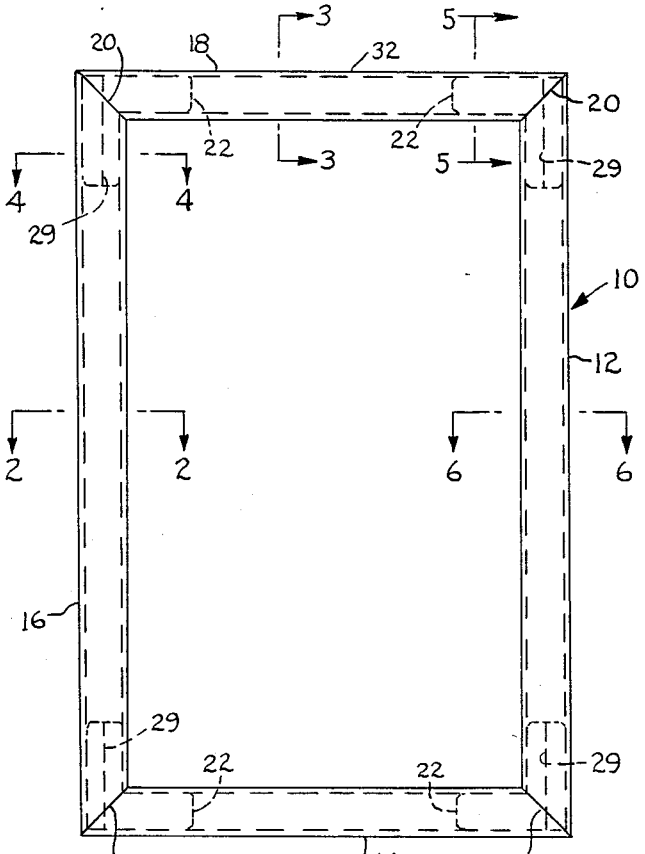
FIG. 1 is a front elevational view of a picture frame embodying my invention.

FIG. 1 shows one form that the invention can take. Shown is a rectangular frame 10 comprised of four hollow tubes 12, 14, 16 and 18. Each tube has a circular cross section (except that slots extend along the inner faces of the tubes so that the actual tube cross section is C-shaped). The ends of each tube are cut on the bias at a forty five degree angle to form miter joints at the four corners of the frame; the miter joints are designated by numeral 20 in the drawings. Each tube is preferably a thin-walled plastic tube having a relatively low weight per unit length. By using low weight tubing it is possible to have a low weight frame structure that can be magnetically adhered to a steel refrigerator surface without danger of gravitationally falling away.

Figure 7:
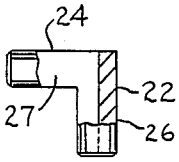
FIG. 7 is a sectional view taken through a corner connector used in the FIG. 1 frame.

Conceivably the mitered corners 20 of the tubes could be adhesively secured together to form a rectangular picture frame. However, since the tubing is thin walled tubing, there is only a limited contact area at corners 20. Therefore, more rigid corner connections may be achieved by using L-shaped tube connectors 22 to connect the tubes together. FIG. 7 shows the tube connector per se (apart from the tubing).

Each L-shaped connector 22 comprises two legs 24 and 25 arranged at right angles to each other; each leg has a circular (cylindrical) surface contour mated to the inner surface contour of the plastic tubing. Adhesives may be used on the cylindrical surfaces to form permanent bonds between the connector and the tubing.

Each connector has a slot 27 extending transversely through leg 24 and part way through leg 26; the slot forms an internal end surface 29 in leg 26. The four corner connectors are installed in the plastic tubes so that slot surfaces 29 are parallel to tubes 12 and 16, i.e. the length dimension of the picture frame.

Figure 8:
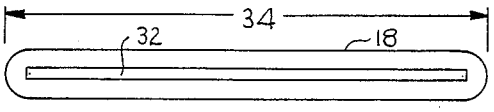
FIG. 8 is a top edge view of the FIG. 1 frame.

Each tube 12, 14, 16 or 18 has a full length slot 30 in the surface thereof that faces the space circumscribed by the frame structure. The four slots 30 collectively receive edge areas of a sheet (not shown) inserted into the frame by the user. Initial insertion of the sheet into the frame is through a slot 32 formed in the upper side surface of tube 18. Numeral 34 in FIG. 8 references the length of tube 18 that contains slot 32. The aforementioned slots 27 in corner connectors 22 are aligned with end sections of slot 32, such that a sheet of material having a width somewhat less than slot dimension 34 can be inserted into frame 10. The sheet is pushed down until the lower edge of the sheet is within tube 14. Slots 30 in the four tubes accommodate edge sections of the sheet to retain the sheet in frame 10.

Figure 9:
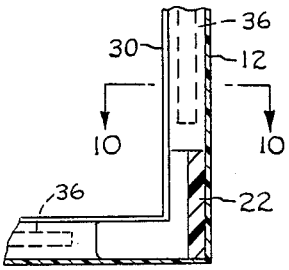
FIG. 9 is a fragmentary view of a second form that the invention can take.
Figure 2:
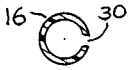
FIGS. 2 through 6 are sectional views taken, respectively, on lines 2—2, 3—3, 4—4, 5—5, 6—6 in FIG. 1.
Figure 3:
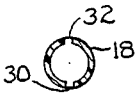
Figure 4:
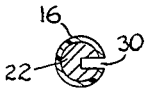
Figure 5:
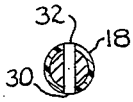
Figure 6:
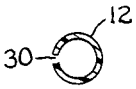

The frame has magnet means thereon for magnetically adhereing the frame to a steel refrigerator surface or other steel surface. FIG. 9 shows one form the the magnet means can take. Magnet strips 36 are adhesively secured to the rear faces of the four tubes 12, 14, 16 and 18. Each magnet strip can extend along the tube surface for substantially the entire tube length to provide an extensive magnetic attractive force.

Figure 10:
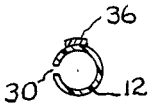
FIG. 10 is a sectional view on line 10—10 in FIG. 9.

As an alternative to magnet strips 36 it is possible to embody magnets in corner connectors 22, i.e. by forming the magnets out of a magnetizable material and then subjecting the formed connectors to magnetizing process. FIG. 7 is intended to show an end connector constructed to act as a magnet. FIGS. 9 and 10 show an arrangement where separate magnetic strips 36 are used to provide the magnetic attractive force. In the FIG. 9 arrangement each end connector 22 may be formed of light weight plastic to reduce the overall weight of the frame structure.

The completed frame may be of various sizes, e.g. nine inch by twelve inch, or three inch by five inch. The tubes used to form the frame preferably have circular cross sections, since such a cross section exhibits very good resistance against transverse flexure or non-straightness. The tubes are formed of plastic material that may be transparent and/or colored and/or translucent.

I claim:

1. A rectangular frame for displaying a sheet of informational material on an outer surface of a refrigerator or other steel surface:

said frame being comprised of four tubes extending right angularly from one another in planar alignment; the ends of each tube being cut on the bias at a forty five degree angle to form miter joints at the frame corners;

full length slots in the inner facing surfaces of the tubes for accommodating edge areas of a sheet of material;

an elongated slot (32) in the outer surface of one of the tubes permitting insertion of a sheet into the frame;

L-shaped tube connectors (22) inserted into the ends of the meeting tubes at the four miter joints;

each tube connector having two legs (24 and 26) extending at right angles to each other, and a slot (27) extending completely through one leg and partway through the other leg;

the slots in the L-shaped connectors being aligned with the slots in the inner facing surfaces of the tubes and said elongated slot in the outer surface of one of the tubes so that when a sheet of material is inserted through the elongated slot edge areas of the sheet will extend through the slots in the facing surfaces of the tubes into the slots in the L-shaped connectors.

2. The frame of claim 1 wherein each tube and each leg of each corner connector has a circular cross section.

3. The frame of claim 2 wherein each L-shaped tube connector is a permanent magnet; each leg of each connector having a circular cross section mated to the inner surface contour of the associated tube.

4. The frame of claim 3 wherein each tube is a thin walled plastic tube.

* * * * *